US008777671B2

(12) United States Patent
Huang

(10) Patent No.: US 8,777,671 B2
(45) Date of Patent: Jul. 15, 2014

(54) MULTI-DIRECTION ADJUSTABLE CONNECTOR JOINT STRUCTURE

(71) Applicant: Kui-Hsien Huang, Taipei (TW)

(72) Inventor: Kui-Hsien Huang, Taipei (TW)

( * ) Notice: Subject to any disclaimer, the term of this patent is extended or adjusted under 35 U.S.C. 154(b) by 30 days.

(21) Appl. No.: 13/671,564

(22) Filed: Nov. 8, 2012

(65) Prior Publication Data

US 2014/0127937 A1 May 8, 2014

(51) Int. Cl.
*H01R 25/00* (2006.01)

(52) U.S. Cl.
USPC ..... 439/640; 439/6; 439/11

(58) Field of Classification Search
USPC ..... 439/640, 6, 11, 647, 534, 165, 238, 439/261, 341, 376, 446
See application file for complete search history.

(56) References Cited

U.S. PATENT DOCUMENTS 5,860,824 A * 1/1999 Fan ..... 439/265
6,786,734 B2 * 9/2004 Yu ..... 439/11
6,991,467 B1 * 1/2006 Cheng et al. ..... 439/10
7,128,615 B1 * 10/2006 Liao ..... 439/640
7,811,136 B1 * 10/2010 Hsieh et al. ..... 439/640

* cited by examiner

*Primary Examiner* — Renee Luebke
*Assistant Examiner* — Harshad Patel
(74) *Attorney, Agent, or Firm* — Leong C. Lei

(57) ABSTRACT

A multi-direction adjustable connector joint structure includes a coupler, a first connection joint, a second connection joint, and a plurality of signal connection wires. The coupler has an end forming a longitudinal joint section for coupling the first connection joint to allow the first connection joint to effect adjustment through longitudinal displacement and an opposite end forming a lateral joint section for coupling the second connection joint to allow the second connection joint to effect adjustment through lateral displacement. The first connection joint is provided with a first connector. The second connection joint is provided with a signal transmission cable. The signal connection wires electrically connect between the first connector and the signal transmission cable. The arrangement that the first and second connection joints are respectively adjustable through longitudinal and lateral displacement provides the first connector with a mechanism of multi-directional adjustment in upward, downward, leftward, and rightward directions.

8 Claims, 7 Drawing Sheets

MULTI-DIRECTION ADJUSTABLE CONNECTOR JOINT STRUCTURE

TECHNICAL FIELD OF THE INVENTION

The present invention generally relates to a multi-direction adjustable joint structure, and more particularly to a joint structure that comprises a coupler having one end coupling a first connection joint in a longitudinal way and an opposite end coupling a second connection joint in a lateral way so as to allow the first and second connection joints to respectively do longitudinal and vertical movements for adjustment and also comprises a connector accommodated in the first connection joint to allow the connector to achieve adjustment in multiple directions including upward and downward and leftward and rightward.

DESCRIPTION OF THE PRIOR ART

The fast progress of technology brings human being electronic products as a doorway toward worldwide span of knowledge. The electronic products are gradually becoming a must for daily living of modern people. The development of electronic products is now focused on being lightweight and compact size. The modern electronic devices are provided with connector sockets (such as USB, HDMI, and Display Port) that are capable of transmission of data in different transmission rate and power for connection with a connection plug of the same specification.

However, the conventional structure of connection plug are of a fixed arrangement that is not rotatable, making it not possible to defect or bend as desired by a user. Consequently, a cable connected to the connection plug must be folded and bent at the portion thereof connected to the connection plug. The portion of the cable that is subjected to long term folding and bending may lead to poor conditions of use, such as getting broken and severe twisted.

To cope with such a problem, a direction-changeable connector joint structure is available. An example is Taiwan Utility Model M362558, which discloses a transmission electrical connector having a plug that is multi-direction rotatable by having a coupling member coupling between a base and the plug. The coupling member is rotatable in upward and downward directions with respect to the connection member in order to effect multi-directional rotation of the plug.

Such a device provides a constraint to the rotatable range of the plug with respect to the connection member in order to protect internal transmission cables from damage caused by over-rotation of the plug. However, if an undue force is applied by a user to rotate the plug, it is still possible to cause over-rotation of the plug and thus lead to undesired over-stretching and thus breaking of the internal transmission cable. The present invention is made to overcome such a problem.

SUMMARY OF THE INVENTION

In view of the above shortcomings, the present invention provides a multi-direction adjustable connector joint structure, which comprises a coupler, a first connection joint, a second connection joint, and a plurality of signal connection wires. The coupler has an end forming a longitudinal joint section and an opposite end forming a lateral joint section. The first connection joint has an end forming a first pivoting section coupleable to the longitudinal joint section of the coupler so as to effect adjustment of the first connection joint through longitudinal (vertical) displacement. The second connection joint has an end forming a second pivoting section coupleable to the lateral joint section of the coupler so as to effect adjustment of the second connection joint through lateral (horizontal) displacement. Further, the first connection joint has an opposite end to which a first connector is provided. The second connection joint has an opposite end to which a signal transmission cable is provided. The plurality of signal connection wires sequentially extends through interiors of the coupler, the first connection joint, and the second connection joint and electrically connects between the first connector and the signal transmission cable to establish electrical connection between the first connector and the signal transmission cable. As such, the arrangement that the first connection joint is adjustable with respect to the longitudinal joint section of the coupler through longitudinal (vertical) displacement and the arrangement that the second connection joint is adjustable with respect to the lateral joint section of the coupler through lateral (horizontal) displacement provide the first connector (or the signal transmission cable) with a mechanism of multi-directional adjustment in upward, downward, leftward, and rightward directions. Further, the first connection joint comprises means for imposing a limitation to longitudinal displacement and the second connection joint comprises means for imposing a limitation to lateral displacement, whereby over rotation of the joint caused by a user excessively rotating the joint through application of an excessive force that leads to entangling and breaking of the internal transmission wires due to over stretching can be prevented.

Further, in another embodiment of the present invention, the opposite end of the second connection joint is alternatively provided with a second connector. The arrangement that the first connection joint is adjustable with respect to the longitudinal joint section of the coupler through longitudinal (vertical) displacement and the arrangement that the second connection joint is adjustable with respect to the lateral joint section of the coupler through lateral (horizontal) displacement provide the first connector (or the second connector) with a mechanism of multi-directional adjustment in upward, downward, leftward, and rightward directions.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
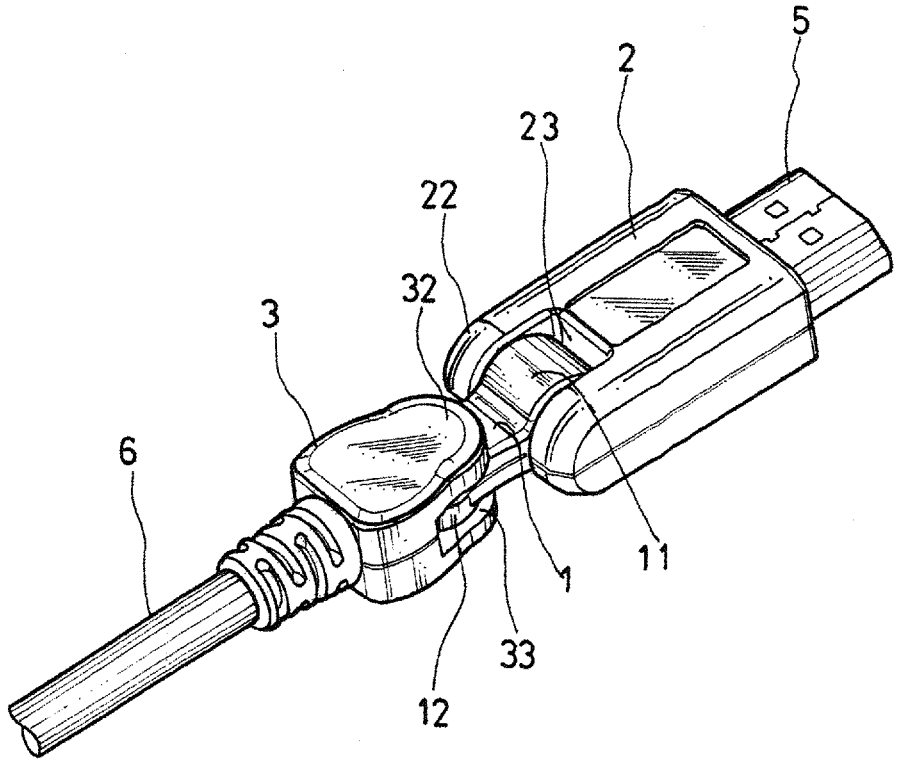
FIG. 1 is a perspective view showing a connector joint structure according to a first embodiment of the present invention in an assembled form.
Figure 2:
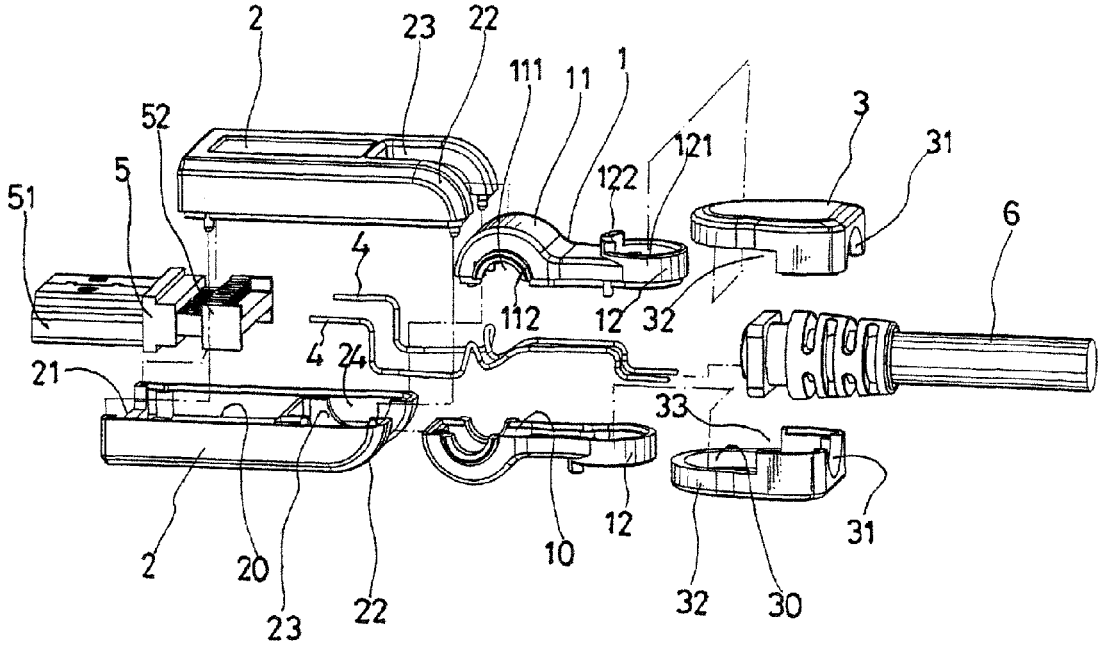
FIG. 2 is an exploded view showing the connector joint structure according to the first embodiment of the present invention.
Figure 3:
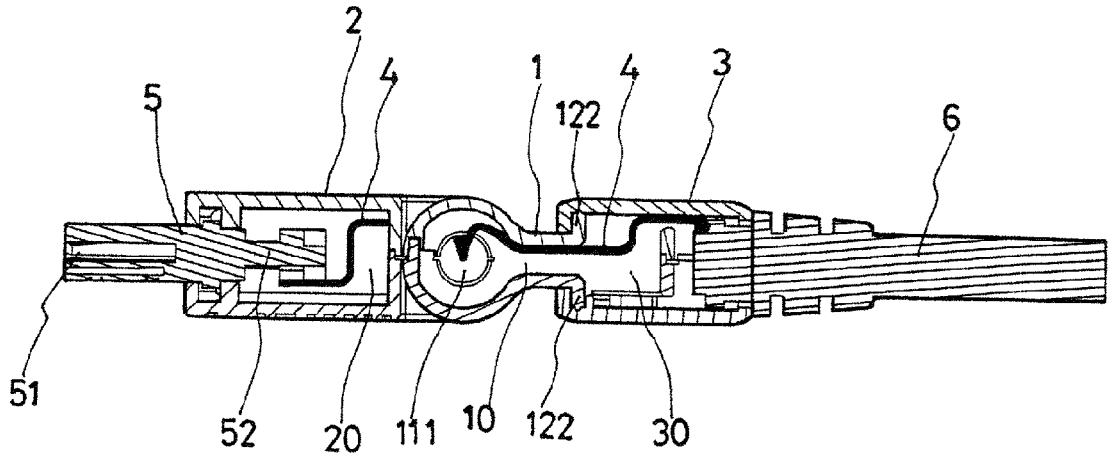
FIG. 3 is a cross-sectional view showing the connector joint structure according to the first embodiment of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1, 2, 3, and 4, the present invention discloses a multi-direction adjustable connector joint structure, which comprises a coupler 1, a first connection joint 2, a second connection joint 3, and a plurality of signal connection wires 4.

The coupler 1 forms therein an accommodation space 10. The coupler 1 has an end forming a longitudinal joint section 11 and an opposite end forming a lateral joint section 12. The longitudinal joint section 11 has opposite left and right sides that form aligned first through holes 111. A first raised portion 112 is formed along a circumference of each of the first through holes 111. The lateral joint section 12 has opposite upper and lower sides forming aligned second through holes 121. A second raised portion 122 is formed along a circumference of each of the second through holes 121. The first through holes 111 and the second through holes 121 are in communication with the accommodation space 10. Furthermore, the coupler 1 is composed of an upper casing member and a lower casing member that mate and are combined to each other.

The first connection joint 2 is coupled to the longitudinal joint section 11 of the coupler 1 and forms therein an accommodation space 20. The first connection joint 2 has an end forming a first opening section 21 and an opposite end forming a first pivoting section 22. The first connection joint 2 comprises a first connector 5 that is received in the first opening section 21. The first connection joint 2 forms a longitudinal channel 23 in the first pivoting section 22. The longitudinal channel 23 has opposite inside walls forming aligned pivot recesses 24. The pivot recesses 24 are in communication with the accommodation space 20. Further, the longitudinal joint section 11 of the coupler 1 is received in the longitudinal channel 23 of the first pivoting section 22 in such a way that the first through holes 111 of the coupler 1 are positioned to correspond to the pivot recesses 24 of the first connection joint 2 and the first raised portions 112 are respectively fit in the pivot recesses 24, whereby the first connection joint 2 is rotatable with respect to the coupler 1 for effecting adjustment through longitudinal (vertical) displacement.

The first connection joint 2 is composed of an upper casing member and a lower casing member that mate and are combined with each other. Further, the first connector 5 has an end forming a first connection port 51 exposed outside the first connection joint 2 and an opposite end forming a first terminal port 52 that is received inside the first connection joint 2. In other words, the first terminal port 52 of the first connector 5 is received in the accommodation space 20 of the first connection joint 2. In an example, the first connector 5 is a plug type connector. Alternatively, the first connector 5 can be a socket type connector.

The second connection joint 3 is coupled to the lateral joint section 12 of the coupler 1 and forms therein an accommodation space 30. The second connection joint 3 has an end forming second opening section 31 and an opposite end forming a second pivoting section 32. The second connection joint 3 comprises a signal transmission cable 6 arranged in the second opening section 31. The second connection joint 3 forms a lateral channel 33 in the second pivoting section 32. The lateral joint section 12 of the coupler 1 is received in the lateral channel 33 of the second pivoting section 32 in such a way that the second through holes 121 of the coupler 1 are positioned inside the accommodation space 30 of the second connection joint 3 with the second raised portions 122 respectively fit to inside walls of the lateral channel 33, whereby the second connection joint 3 is rotatable with respect to the coupler 1 for effecting adjustment through lateral (horizontal) displacement. The second connection joint 3 is composed of an upper casing member and a lower casing member that mate and are combined with each other.

A plurality of the signal connection wires 4 is sequentially received through the accommodation spaces 10, 20, 30 formed in the coupler 1, the first connection joint 2, and the second connection joint 3. And, the signal connection wires 4 each have an end electrically connected to the signal transmission cable 6. Further, the signal connection wires 4 extend from the accommodation space 30 of the second connection joint 3 through the second through holes 121 of the coupler 1 to reach into the accommodation space 10 and further extend through the first through holes 111 of the coupler 1 and the pivot recesses 24 of the first connection joint 2 to enter the accommodation space 20 of the first connection joint 2 so as to allow an opposite end of each of the signal connection wires 4 to electrically connect to the first terminal port 52 of the first connector 5. In other words, the signal connection wires 4 are electrically connected between the first connector 5 and the signal transmission cable 6 to establish an electrical conductive structure between the first connector 5 and the signal transmission cable 6.

Figure 4:
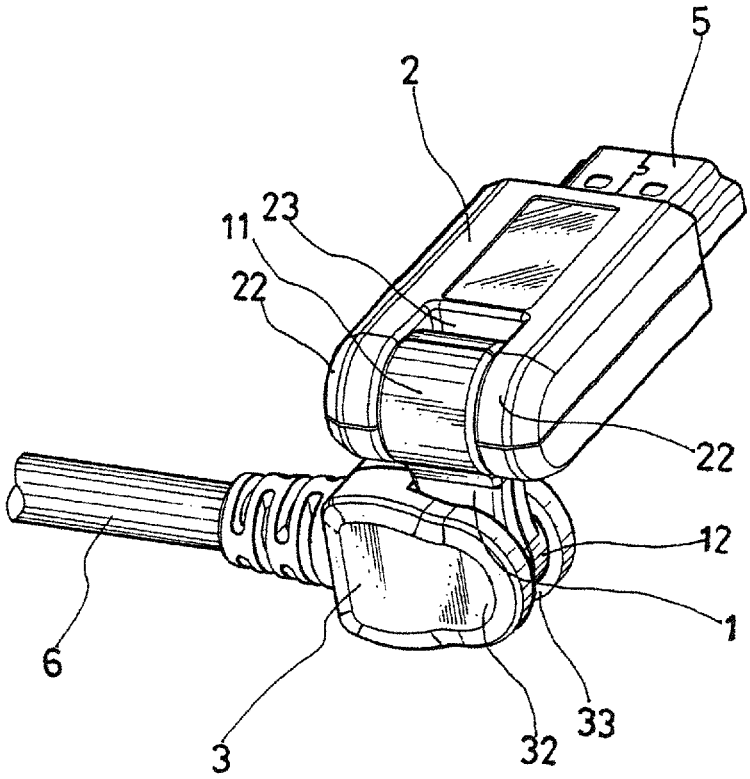
FIG. 4 is a perspective view showing a condition of use of the connector joint structure according to the first embodiment of the present invention.

In this way, the arrangement of the first connection joint 2 that is rotatable with respect to the longitudinal joint section 11 of the coupler 1 to effect adjustment through longitudinal (vertical) displacement and the arrangement of the second connection joint 3 that is rotatable with respect to the lateral joint section 12 of the coupler 1 to effect adjustment through lateral (horizontal) displacement provide the first connector 5 or the signal transmission cable 6 with an adjustable mechanism in multiple directions through displacement in upward, downward, leftward, and rightward directions, whereby a user may adjust the first connector 5 or the signal transmission cable 6 in any desired direction as desired (as shown in FIG. 4). Further, the first connection joint 2 is provided with means for imposing a limitation to longitudinal displacement and the second connection joint 3 is provided with means for imposing a limitation to lateral displacement, whereby over rotation of the joint caused by the user excessively rotating the joint through application of an excessive force that leads to entangling and breaking of the internal transmission wires due to over stretching can be prevented.

Figure 5:
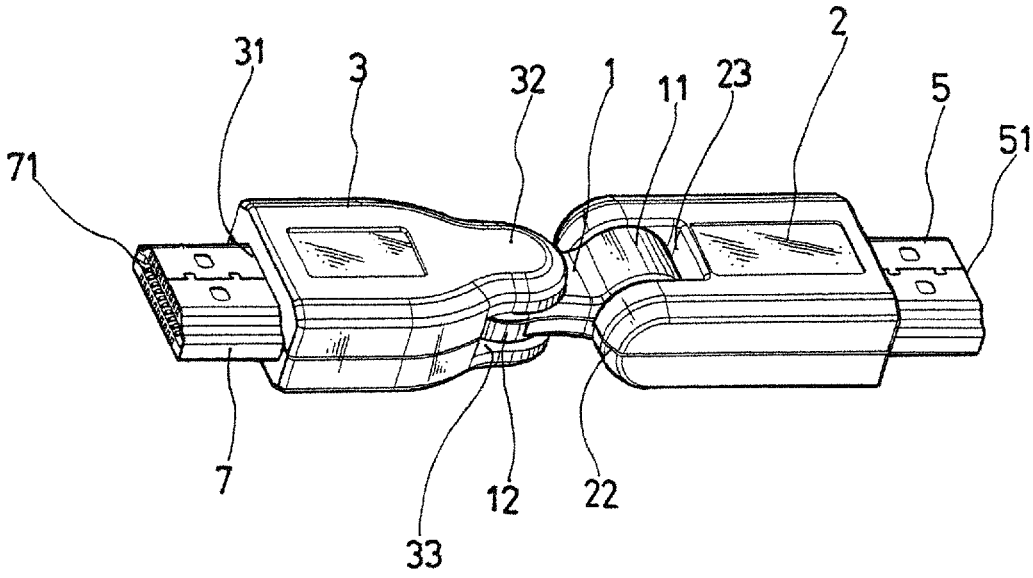
FIG. 5 is a perspective view showing a connector joint structure according to a second embodiment of the present invention in an assembled form.
Figure 6:
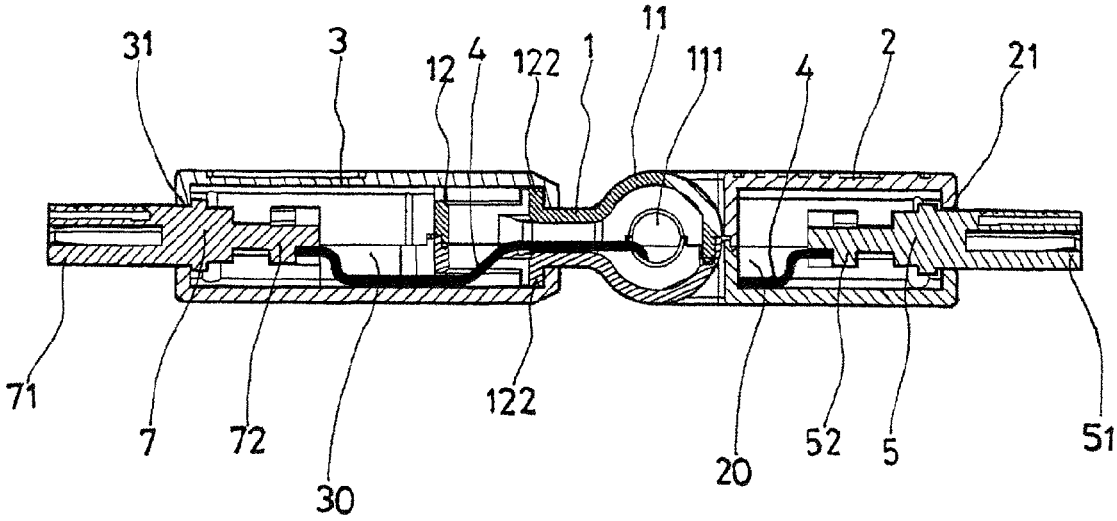
FIG. 6 is a cross-sectional view showing the connector joint structure according to the second embodiment of the present invention.
Figure 7:
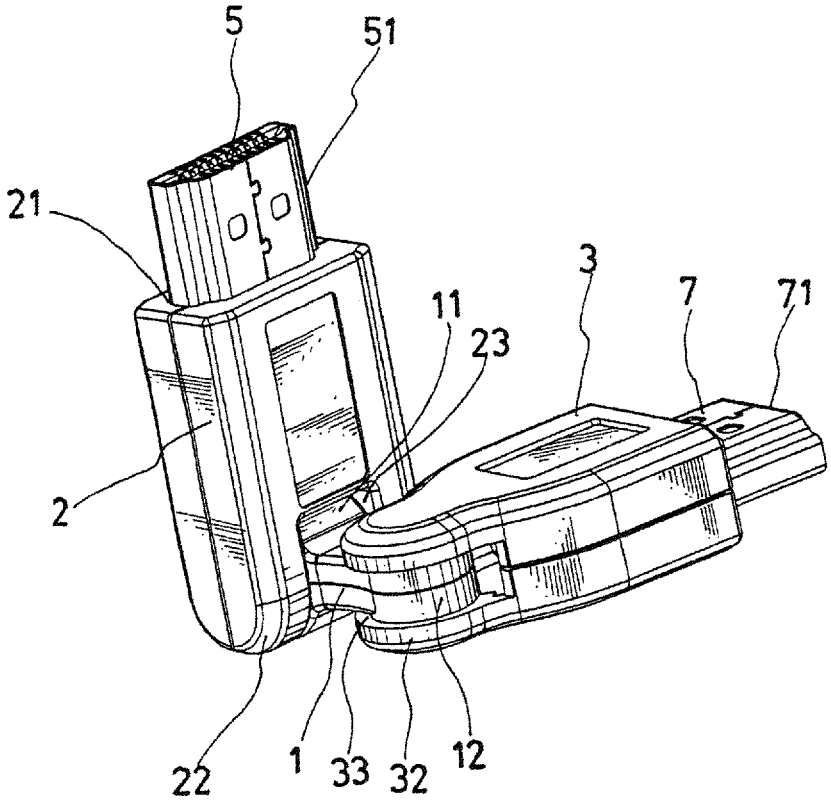
FIG. 7 is a perspective view showing a condition of use of the connector joint structure according to the second embodiment of the present invention.

Referring to FIGS. 5, 6, and 7, another embodiment of the connector joint structure according to the present invention is shown, wherein the second opening section 31 of the second connection joint 3 alternatively receives other signal transmission device therein.

An example will be described, wherein the second opening section 31 of the second connection joint 3 receives and retains therein a second connector 7. The second connector 7 has an end forming a second connection port 71 exposed outside the second connection joint 3 and another end forming a second terminal port 72 received in the second connection joint 3. In other words, the second terminal port 72 of the second connector 7 is received in the accommodation space 30 of the second connection joint 3. The signal connection wires 4 electrically connects between the first terminal port 52 of the first connector 5 and the second terminal port 72 of the second connector 7 to establish electrical conduction between the first connector 5 and the second connector 7. The second connector 7 can be of a plug type configuration or alternatively, the second connector 7 is of a socket type.

In this way, the user is allowed to adjust the first connector 5 or the second connector 7 in any desired direction to meet the need for operation (as shown in FIG. 7).

It is noted that the first connector 5 and the second connector 7 can be both plug type (male connector) or the first connector 5 and the second connector 7 can be both socket type (female connector). Alternatively, the first connector 5 and the second connector 7 can be arranged in such a way that one of them is a plug type (male connector) while the other is a socket type (female connector).

Thus, the technical features of the present invention is that a coupler 1 has an end coupled to a first connection joint 2 in a longitudinal coupling manner and another end of the coupler 1 is coupled to a second connection joint 3 in a lateral coupling manner so that the first connection joint 2 and the second connection joint 3 can respectively perform adjustments through displacements in longitudinal and lateral direction. Further, the first connection joint 2 or the second connection joint 3 is provided with a connector so that a mechanism of multi-directional adjustment in upward, downward, leftward, and rightward directions is achieved for the connector.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A multi-direction adjustable connector joint structure, comprising:

a coupler, which forms therein an accommodation space, the coupler having an end forming a longitudinal joint section and an opposite end forming a lateral joint section;

a first connection joint, which is coupled to the longitudinal joint section of the coupler to allow the first connection joint to be longitudinally displaceable for adjustment, the first connection joint forming therein an accommodation space, the first connection joint having an end forming a first opening section and an opposite end forming a first pivoting section, the first opening section comprising a first connector arranged therein, the first pivoting section forming a longitudinal channel, the longitudinal joint section of the coupler being coupled to the longitudinal channel of the first pivoting section;

a second connection joint, which is coupled to the lateral joint section of the coupler to allow the second connection joint to be laterally displaceable for adjustment, the second connection joint forming therein an accommodation space, the second connection joint having an end forming a second opening section and another end forming a second pivoting section, the second pivoting section forming a lateral channel, the lateral joint section of the coupler being coupled in the lateral channel of the second pivoting section;

a plurality of signal connection wires, the signal connection wires being arranged to sequentially extend through the accommodation spaces of the coupler, the first connection joint, and the second connection joint, the signal connection wires each having an end electrically connected to first connectors;

wherein the longitudinal joint section has opposite left and right sides that form aligned first through holes, a first raised portion being formed along a circumference of each of the first through holes, the longitudinal channel having opposite inside walls forming aligned pivot recesses, the pivot recesses being in communication with the first through holes, the first raised portions being respectively fit into the pivot recesses.

2. The multi-direction adjustable connector joint structure according to claim 1, wherein the lateral joint section has opposite upper and lower sides forming aligned second through holes, a second raised portion being formed along a circumference of each of the second through holes, the second raised portions being respectively fit to inside walls of the lateral channel.

3. The multi-direction adjustable connector joint structure according to claim 1, wherein the first connector has an end forming a first connection port and an opposite end forming a first terminal port, the first connection port being exposed outside the first connection joint, the first terminal port being received in the accommodation space of the first connection joint, the first terminal port being electrically connected to the signal connection wires.

4. The multi-direction adjustable connector joint structure according to claim 1, wherein the first connector is of a plug type or a socket type.

5. The multi-direction adjustable connector joint structure according to claim 1, wherein the second opening section of the second connection joint comprises a signal transmission cable, the signal connection wires each having an end electrically connected to the signal transmission cable, whereby the first connector and the signal transmission cable are in electrical connection.

6. The multi-direction adjustable connector joint structure according to claim 1, wherein the second opening section of the second connection joint comprises a second connector, the signal connection wires each having an end electrically connected to the second connector, whereby the first connector and the second connector are in electrical connection.

7. The multi-direction adjustable connector joint structure according to claim 6, wherein the second connector has an end forming a second connection port and an opposite end forming a second terminal port, the second connection port being exposed outside the second connection joint, the second terminal port being received in the accommodation space of the second connection joint, the second terminal port being electrically connected to the signal connection wires.

8. The multi-direction adjustable connector joint structure according to claim 6, wherein the second connector is of a plug type or a socket type.

* * * * *